US008695389B2

(12) United States Patent
Gueble

(10) Patent No.: US 8,695,389 B2
(45) Date of Patent: Apr. 15, 2014

(54) MECHANICAL MODULE FOR A VEHICLE KEY AND A KEY PROVIDED WITH SUCH A MODULE

(75) Inventor: Christophe Gueble, Paris (FR)

(73) Assignee: Johnson Controls Technology Company, Holland, MI (US)

( * ) Notice: Subject to any disclaimer, the term of this patent is extended or adjusted under 35 U.S.C. 154(b) by 106 days.

(21) Appl. No.: 12/847,936

(22) Filed: Jul. 30, 2010

(65) Prior Publication Data

US 2011/0030430 A1 Feb. 10, 2011

(30) Foreign Application Priority Data

Aug. 7, 2009 (FR) ..... 09 03894

(51) Int. Cl.
*A44B 15/00* (2006.01)
*A45C 11/32* (2006.01)
*A47G 29/10* (2006.01)

(52) U.S. Cl.
USPC ..... 70/456 R; 70/396; 70/399; 70/459

(58) Field of Classification Search
CPC .. A45C 11/324; A45C 11/323; A45C 11/328; A45C 11/32; A44B 15/00
USPC ..... 292/DIG. 61; 24/3.6; 70/DIG. 52, 397, 70/396, 398, 395, 408, 399, 459, 456 R; 206/37.5, 38.1, 37.2, 37.1, 37.4
See application file for complete search history.

(56) References Cited

U.S. PATENT DOCUMENTS

| | | | | |
|---|---|---|---|---|
| 4,736,972 | A * | 4/1988 | Mosch | 292/204 |
| 5,943,889 | A * | 8/1999 | Chiu | 70/456 R |
| 6,499,326 | B1 * | 12/2002 | Heussner | 70/399 |
| 6,691,539 | B2 * | 2/2004 | Jacob et al. | 70/408 |
| 6,705,141 | B1 * | 3/2004 | Jacob et al. | 70/408 |
| 7,370,501 | B2 * | 5/2008 | Miyata et al. | 70/395 |
| 2007/0062229 | A1 * | 3/2007 | Miyata et al. | 70/408 |
| 2007/0220936 | A1 | 9/2007 | Miyata et al. | |
| 2009/0217722 | A1 * | 9/2009 | Luo et al. | 70/459 |
| 2012/0060572 | A1 * | 3/2012 | Box et al. | 70/396 |

FOREIGN PATENT DOCUMENTS

| | | | |
|---|---|---|---|
| DE | 1020070 17 208 | A1 | 10/2008 |
| EP | 1 889 992 | A1 | 2/2008 |
| FR | 2815521 | A1 | 4/2002 |

OTHER PUBLICATIONS

European Search Report mailed Aug. 26, 2010 in EP 10 00 7145, 4 pages.

* cited by examiner

*Primary Examiner* — Lloyd Gall
*Assistant Examiner* — David E Sosnowski
(74) *Attorney, Agent, or Firm* — Foley & Lardner LLP

(57) ABSTRACT

The present invention relates to a key and to a mechanical module for a key having a key body and a key bit fitted to this key body such that it can pivot about a rotation axis between a use position and a stowed away position, the mechanical module being of the type comprising a pivoting support, holding the key bit and engaging with a control button, the control button having a first mechanical means for preventing rotation which is able to engage with a second mechanical means for preventing rotation of a casing element of the key body, it being possible for the control button to be positioned in a normal position and in a position in which it is depressed parallel to the rotation axis, the first mechanical means engaging with the second mechanical means at least at four points around the rotation axis when the control button is in its normal position.

10 Claims, 2 Drawing Sheets

MECHANICAL MODULE FOR A VEHICLE KEY AND A KEY PROVIDED WITH SUCH A MODULE

The present invention relates to a mechanical module for a vehicle key and to a key provided with such a module.

Vehicle keys are generally known. They are particularly intended, for example, for locking or unlocking opening leaves of the vehicle, for example doors, or for controlling a tailgate, an antitheft device and/or a vehicle starter.

Furthermore, vehicle keys are known, in particular from French patent application FR 2 815 521 A1, which comprise a key body and a key bit fitted to this key body such that it can pivot about a rotation axis between a use position, on the one hand, and a stowed away position, on the other.

Usually, the body of the key forms a casing for electronic remote control means for controlling the means of locking the vehicle opening leaves. The body of the key may have different forms depending in particular on the desired esthetic effect.

One drawback with such keys according to the prior art lies in the need to provide strengthening elements in order to ensure that the key bit remains in its use position even if a considerable mechanical force is applied to it, for example the weight of a key ring when the key is positioned in the ignition barrel of the automobile.

The present invention has in particular the aim of alleviating the drawbacks of the prior art, in particular those cited hereinabove, and also has the aim of providing a mechanical module for a vehicle key and also a key enabling the vehicle key to be produced at low cost, to be very small in size and to be robust.

According to the invention, this aim is achieved by a mechanical module for a key having a key body and a key bit fitted to this key body such that it can pivot about a rotation axis between a use position and a stowed away position, the mechanical module being of the type comprising a pivoting support, holding the key bit and engaging with a control button, the control button having a first mechanical means for preventing rotation which is able to engage with a second mechanical means for preventing rotation of a casing element of the key body, it being possible for the control button to be positioned in a normal position and in a position in which it is depressed parallel to the rotation axis, the first mechanical means engaging with the second mechanical means at least at four points around the rotation axis when the control button is in its normal position.

Thus, it is advantageously possible to produce the vehicle key assembly, and in particular the mechanical module, so as to be very strong. A force tending to pivot the key bit when the control button is in its normal position can be absorbed at least at four points around the rotation axis, thereby making it possible to obtain increased strength for preventing rotation between the key bit, on the one hand, and the key body, on the other, when the control button is not depressed.

In a preferred improvement of the invention, the second mechanical means for preventing rotation is positioned around an opening in the casing element.

With such an embodiment, it is advantageously possible for the vehicle key to be produced in a much smaller size, in particular for the mechanical module.

In another preferred improvement of the invention, the second mechanical means for preventing rotation of the casing element is provided in a manner integrated with the casing element and consists in particular of the same material as the casing element.

Thus, it is advantageously possible to reduce the manufacturing cost of the mechanical module and of the vehicle key since the second mechanical means for preventing rotation can be produced from plastic.

According to another preferred embodiment, the control button is returned elastically, parallel to the rotation axis, to its normal position.

In another preferred improvement of the invention, the control button has a third mechanical means for axially guiding and preventing rotation of the control button with respect to the pivoting support, and the pivoting support has a fourth mechanical means for axially guiding and preventing rotation of the control button with respect to the pivoting support.

Thus, it is advantageously possible for the mechanical module of the key to be produced so as to operate in a simple and efficient manner.

In yet another preferred improvement of the invention, the third and fourth mechanical means comprise at least one slider integral with the control button and engaging with a complementary groove in the pivoting support.

With such an embodiment, it is advantageously possible for the relative movement between the pivoting support, on the one hand, and the control button, on the other, to be produced in a simple and very strong manner with a view to a lengthy period of use.

According to another preferred embodiment, the module comprises means for limiting the axial travel of the control button parallel to the rotation axis.

Thus, it is advantageously possible to limit the range over which the control button can be depressed.

Furthermore, the present invention also relates to a key, in particular a vehicle key, the key comprising a mechanical module according to the present invention.

Further features and advantages of the invention will emerge from reading the following description of a particular and nonlimiting embodiment of the present invention.

BRIEF DESCRIPTION OF THE DRAWINGS

The invention will be better understood from the description hereinbelow, which relates to preferred embodiments, given by way of nonlimiting example and explained with reference to the appended schematic drawings, in which.

DESCRIPTION OF THE DRAWINGS

Figure 1:
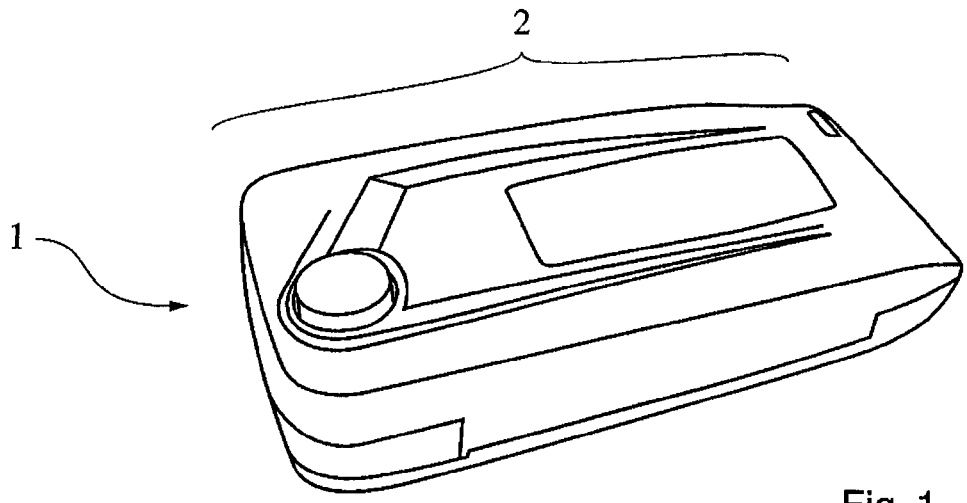
FIG. 1 is a schematic view of a vehicle key according to the present invention, the key comprising a key bit and the key bit being in a stowed away position.
Figure 2:
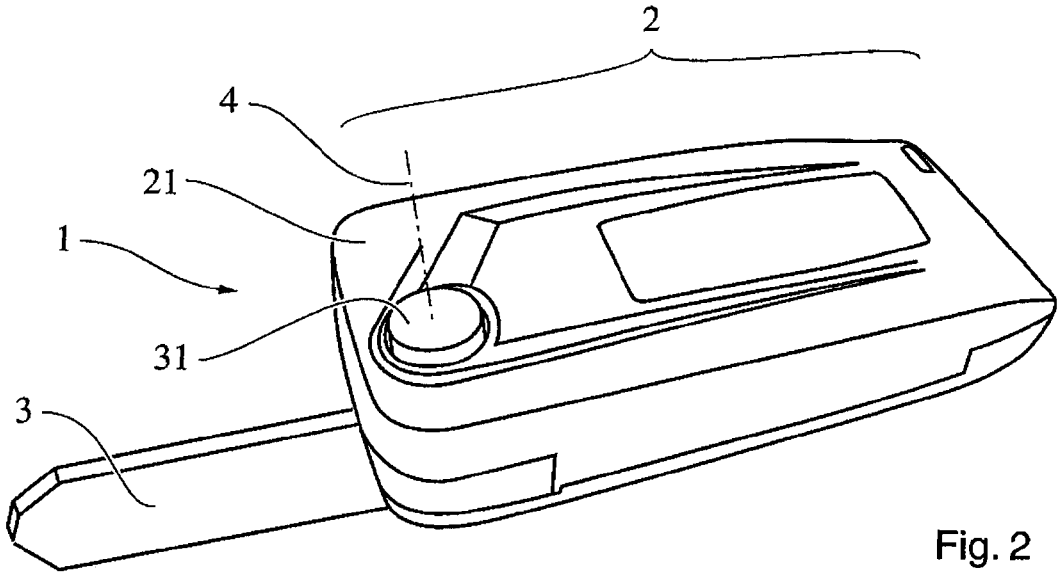
FIG. 2 is a schematic view of the vehicle key according to the present invention, the key comprising a key bit and the key bit being in a use position.

FIGS. 1 and 2 of the appended drawing show a key 1 according to the present invention. This key 1 is intended for example for locking or unlocking vehicle opening leaves, for controlling an antitheft device and a starter of this vehicle, etc. The key 1 comprises a key body 2, in the general form of a yoke, comprising at least one casing element 21 for the key body 2, the casing element 21 being preferably molded in one piece. The key body 2 holds in particular an electronic module and a mechanical module.

The electronic module comprises conventional electronic means intended, for example, for the remote control of means for locking vehicle opening leaves or means for identifying a user who is authorized to use the vehicle.

Figure 3:
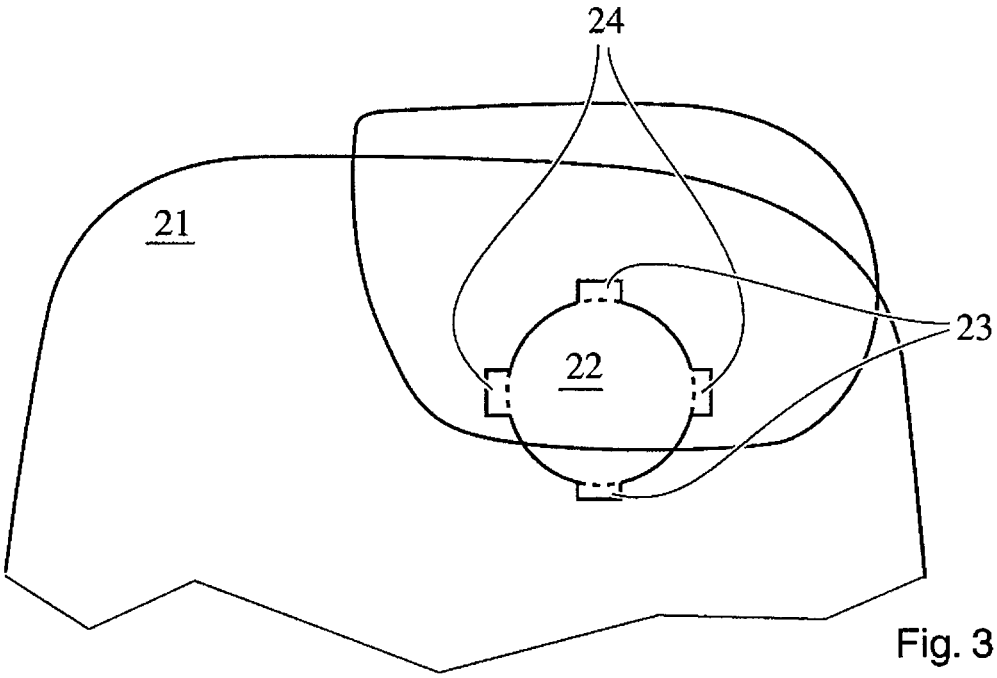
FIG. 3 shows a schematic view of part of the inner surface of a casing element of a key body.
Figure 4:
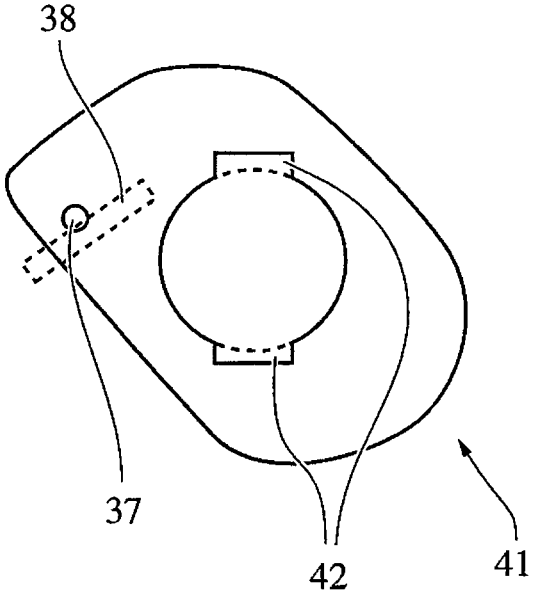
FIG. 4 shows a schematic view of a pivoting support which holds the key bit and which engages with a control button of the key.
Figure 5:
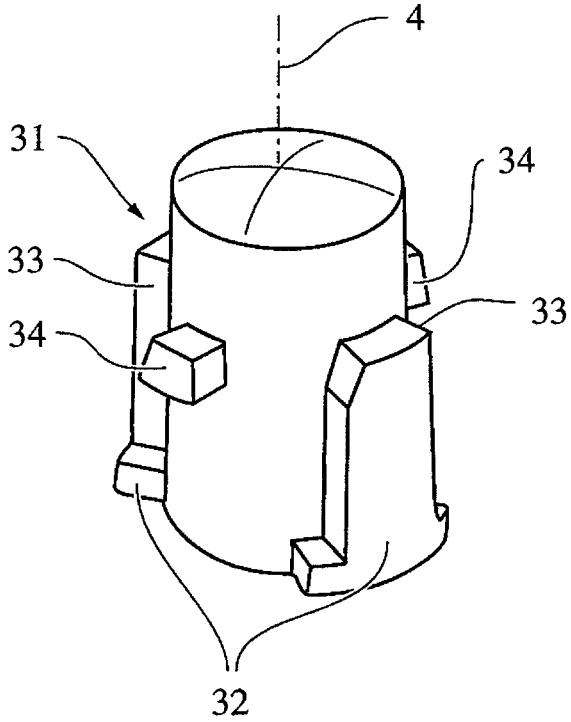
FIG. 5 shows a schematic perspective view of a control button of the key according to the present invention.

The mechanical module, illustrated in greater detail in FIGS. 3 through 5, comprises a pivoting support 41 holding a key bit 3, having a planar general form, which is also called an insert. This key bit 3 is fixed on the pivoting support 41, in particular in a recess 38, by conventional means, for example by keying by means of a pin 37 (see in particular FIG. 4).

The pivoting support 41 is intended to be hinged on the key body 2 such that the key bit 30 can move between a stowed away position, as illustrated in particular in FIG. 1, and a use position, as illustrated in particular in FIG. 2.

The pivoting support 41 is provided with a recess, having a cylindrical general form, coaxial with an imaginary rotation (or pivot) axis 4 of the pivoting support 41 and of the key bit 3 with respect to the key body 2. The recess is intended to hold a control button controlling the movements of the key bit 3 with respect to the key body 2.

The control button 31 can be positioned in a normal position, on the one hand, and in a position in which it is depressed parallel to the rotation axis 4, on the other.

The normal position of the control button 31 is illustrated in FIGS. 1 and 2, which show the stowed away and use positions of the key bit 3. The control button 31 is depressed (by a translational movement parallel to the rotation axis 4) in order for the key bit 3 to pivot from its stowed away position to its use position, or vice versa.

The control button 31 comprises a first mechanical means for preventing rotation that is able to engage with a second mechanical means for preventing rotation of the casing element 21 of the key body 2. The first mechanical element for preventing rotation comprises two first protrusions 33 and two second protrusions 34. The second mechanical element for preventing rotation comprises two first notches 23 and two second notches 24 formed in the casing element 21 of the key body 2, in particular at a peripheral point of (i.e. at a point around) an opening 22 in the casing element 21. The control button 31 is intended to pass at least partially through the opening 22 in the casing element 21 from an inner surface, shown partially in FIG. 3, of the casing element 21. Only the area of the control button 31 which is pressed can be seen from the outer surface of the casing element 21 (as is shown in FIGS. 1 and 2).

In the normal position of the control button 31, the first mechanical means 33, 34 and the second mechanical means 23, 24 engage by interlocking so as to prevent the control button 31 from rotating with respect to the casing element 21.

Preferably, the control button 31 has a third mechanical means 32 for axially guiding and preventing rotation of the control button 31 with respect to the pivoting support 41, and the pivoting support 41 has a fourth mechanical means 42 for axially guiding and preventing rotation of the control button 31 with respect to the pivoting support 41.

The third and fourth mechanical means 32, 42 preferably comprise at least one slider 32 which is integral with the control button 31 and engages with a complementary groove 42 formed in the pivoting support 41.

Since the first mechanical means 33, 34 and the second mechanical means 23, 24 comprise at least four pairs of complementary protrusions and notches, it is advantageously possible for the first and second mechanical means to be able to hold back a significant force tending to pivot the key bit with respect to the body 2 of the key 1.

The invention claimed is:

1. A mechanical module for a key comprising:

a key body that includes a casing element;

a key bit fitted to the key body such that the key bit can pivot about a rotation axis and relative to the casing element between a use position and a stowed away position;

a control button configured to move parallel to the rotation axis between a normal position and a depressed position to allow the key bit to pivot about the rotation axis and relative to the casing element; and a pivoting support, holding the key bit and engaging with the control button;

wherein the control button includes a first mechanical structure comprising at least four protrusions, and the casing element includes a second mechanical structure comprising at least four notches, wherein the first mechanical structure of the control button is configured to engage the second mechanical structure of the casing element by interlocking each of the at least four protrusions with a corresponding one of the at least four notches at least at four spaced-apart locations around the rotation axis for preventing rotation of the control button about the rotation axis relative to the casing element when the control button is in the normal position;

wherein the second mechanical structure is integrated with the casing element and comprises the same material as the casing element;

wherein the first and the second mechanical structures oppose a force tending to pivot the key bit with respect to the body of the key; and wherein the casing element remains stationary relative to the key body as the key bit moves between the use and the stowed away positions.

2. The module as claimed in claim 1, wherein the second mechanical structure for preventing rotation is positioned around an opening in the casing element.

3. The module as claimed in claim 1, wherein the pivoting support can pivot about the rotation axis and relative to the casing element to pivot the key bit, wherein the control button, when in the depressed position, can be rotated relative to the casing element and is prevented from rotating with respect to the pivoting support, wherein the control button passes at least partially through an opening in the casing element from an inner surface of the casing element.

4. The module as claimed in claim 3, wherein the control button has a third mechanical structure for axially guiding the control button to move parallel to the rotation axis and preventing rotation of the control button about the rotation axis with respect to the pivoting support, wherein the pivoting support has a fourth mechanical structure for axially guiding the control button to move parallel to the rotation axis and preventing rotation of the control button about the rotation axis with respect to the pivoting support, wherein the forth mechanical structure comprises a groove in the pivoting support and the third mechanical structure comprises at least one slider integral with the control button, and wherein the slider engages the groove in the pivoting support.

5. The module as claimed in claim 3, wherein the pivoting support is configured to hold the control button, such that the control button is prevented from rotating with respect to the pivoting support.

6. The module as claimed in claim 4, wherein the fourth mechanical structure of the pivoting support holds the third mechanical structure of the control button, such that the control button is prevented from rotating with respect to the pivoting support.

7. The module as claimed in claim 1, wherein the key body limits the axial travel of the control button parallel to the rotation axis.

8. A vehicle key comprising a mechanical module as claimed in claim 1.

9. The module as claimed in claim 1, wherein the at least four notches of the second mechanical structure for preventing rotation includes two first notches and two second notches formed in the casing element of the key body.

10. The module as claimed in claim 9, wherein the two first notches and the two second notches are formed at peripheral points of an opening in the casing element.

* * * * *